United States Patent [19]

Burg et al.

[11] 4,262,598

[45] Apr. 21, 1981

[54] DELAY FUSE

[75] Inventors: Raymond H. Burg; Arthur M. Lohmann, both of Hopkins; William C. George, Minnetonka, all of Minn.

[73] Assignee: The United States of America as represented by the Secretary of the Army, Washington, D.C.

[21] Appl. No.: 29,189

[22] Filed: Apr. 12, 1979

[51] Int. Cl.[3] ..... F42C 15/22

[52] U.S. Cl. ..... 102/246

[58] Field of Search ..... 102/246, 244, 239, 238, 102/237, 273

[56] References Cited

U.S. PATENT DOCUMENTS

| | | | |
|---|---|---|---|
| 1,890,176 | 12/1932 | Brandt | 102/238 |
| 3,066,606 | 12/1962 | Wenig | 102/244 |
| 3,375,787 | 4/1968 | Swanson | 102/246 |
| 3,724,384 | 4/1973 | Donahue | 102/246 |
| 3,913,486 | 10/1975 | Kosonocky et al. | 102/273 |

*Primary Examiner*—Charles T. Jordan

*Attorney, Agent, or Firm*—Nathan Edelberg; Robert P. Gibson; Max Yarmovsky

[57] ABSTRACT

An impact delay fuse for a spin launched shell for delaying detonation of the explosive charge of the shell until after impact of the shell with a target. The impact delay fuse includes a hollow housing adapted to be positioned in the shell for rotation therewith in a first direction about a shell spin axis when the shell is launched, a detonation means for detonating the explosive charge of the shell, a rotatable locking member coaxially mounted within the housing for locking the detonation means in a loaded position, and a sensing and firing mechanism for controlling rotation of the locking member to move the locking member to a release position to release the detonation means to detonate the explosive charge of the shell. The sensing and firing mechanism comprises an inertia member and inertia mounting means for mounting the inertia member coaxially in the housing to rotate with the housing in the first direction when the shell is launched and to rotate the inertia member in the first direction relative to the housing when the shell impacts with the target. Inertia bias means biases the inertia member for rotation in a second direction, opposite to the first direction, relative to the housing and coupling means engage the locking member with the inertia member for rotation therewith only when the inertia member is rotated in the second direction relative to the housing. A time delay device is also provided for preventing movement of the inertia member relative to the housing for a predetermined period after launch to prevent premature detonation of the shell.

20 Claims, 9 Drawing Figures

DELAY FUSE

GOVERNMENTAL INTEREST

The invention described herein may be manufactured, used and licensed by or for the Government for governmental purposes without the payment to us of any royalty thereon.

BACKGROUND OF THE INVENTION

The present invention relates to delay fuses for explosive shells or projectiles, and more particularly to impact delay fuses for such shells for delaying detonation until after impact of the shell with a target.

Various means have been used in prior art to improve the maximum effectiveness of a projectile warhead while maintaining safety and handling. In particular situations, it is advisable to delay detonation of the warhead for a short period of time after initial impact of the projectile with a target. For example, it is in some instances desired to delay detonation of the projectile until the projectile has either passed through the target impact medium, has ricocheted from the impact surface, has broached from the impact surface, or has come to rest in the impact medium. One such prior art device is described in U.S. Pat. No. 3,913,486 for An Automatic Delay Graze Sensitive Fuse which utilizes linear deceleration associated with the impact to cock and then release the firing pin for detonation of the explosive charge of the shell.

However, in some instances, the utilization of linear deceleration has not proven fully satisfactory in that such devices have not been capable of distinguishing between linear deceleration as a result of target penetration and linear deceleration as a result of tumbling of the projectile from the target. Consequently, such prior art projectiles have not always fired when intended. In addition, such linear deceleration initiation type devices have not always proven effective under graze impact situations.

SUMMARY OF THE INVENTION

These and other disadvantages of the prior art are overcome with the present invention. In particular, the present invention is directed to an automatic impact delay fuse for delaying detonation of the explosive charge of spin launched shells until after impact of the shell with the target. The present invention comprises a hollow housing adapted to be positioned in the shell for rotation therewith in a first direction about the shell spin axis when the shell is launched, detonation means for detonating the explosive charge of the shell, and a locking member rotatable relative to the housing between a first position and a second position. When the locking member is in the first position, it serves to maintain the detonation means in a loaded position, whereas when it is in the second position, it serves to release the detonation means to detonate the explosive charge. A sensing and firing mechanism is provided for controlling rotation of the locking member relative to the housing. The sensing and firing mechanism comprises an inertia member, an inertia mounting means for mounting of the inertia member coaxially within the housing, inertia bias means for biasing the inertia member and coupling means for coupling the inertia member with the locking member to produce the desired rotation. The inertia mounting means serves to mount the inertia member within the housing to rotate the inertia member in a first direction with the housing when the shell is launched and to rotate the inertia member in the first direction relative to the housing when the shell impacts with the target. The inertia bias means serves to bias the inertia member for rotation in a second direction relative to the housing, the second direction being opposite from the first direction of rotation. The coupling means serve to engage the locking member with the inertia member for rotation therewith only when the inertia member is rotated in the second direction about the shell spin axis relative to the housing. In this way, upon impact with the target which causes spin or angular deceleration of the shell and thus the housing, the inertia member is caused to rotate in the first direction relative to the housing. Then when the spin deceleration terminates, the biasing means serves to rotate the inertia member in the second direction relative to the housing to thereby rotate the locking member in the second direction relative to the housing which in turn serves to release the detonation means.

In the preferred embodiment, the inertia mounting means may comprise one or both of two different mechanisms. One of these preferred mechanism includes a bearing device for providing free rotation of the inertia member relative to the housing and a stop member mounted within the interior of the housing and engagable with the portion of the inertia member so that upon launch when spin is initiated, the stop member engages the inertia member to rotate the inertia member with the housing. The inertia bias means also serves to bias the inertia member to engagement with the stop member. When the shell impacts with the target and decelerates the spin, the rotational or angular momentum of the inertia member serves to rotate the inertia member against the inertia bias means of the spring, and thus relative to the housing and the locking member. Then, at or near the end of rotational deceleration, the inertia bias means serves to rotate the inertia member in the second direction about the shell spin axis to rotate the locking member to the release position to release the detonation means.

With the other preferred mechanism for the inertia mounting means, the rotation of the inertia member in the first direction relative to the housing is achieved by means of a camming action as a result of linear deceleration of the shell. In this embodiment, the inertia mounting means comprises means for supporting the inertia member for axial or longitudinal movement relative to the housing, and a camming member and corresponding camming surface for causing the inertia member to rotate in the first direction relative to the housing upon linear movement of the inertia member relative to the housing.

With either of these mechanisms for mounting of the inertia member, impact of the shell with the target causes the inertia member to be cocked or rotated in the first direction relative to the housing. Then, at or near the end of rotational deceleration of the shell, the inertia bias means biases the inertia member to rotate in the second direction relative to the housing to cause the coupling member to rotate the locking member in the second direction relative to the housing to thereby release the detonation means.

Further, in accordance with the preferred embodiment of the present invention, there is provided a time delay device for preventing premature detonation of the shell. This time delay device prevents movement of the inertia member relative to the housing for a predetermined period of time after launch of the shell.

These and further features and characteristics of the present invention will be apparent from the following detailed description in which reference is made to the enclosed drawings which illustrate the preferred embodiment of the present invention.

DETAILED DESCRIPTION OF THE PREFERRED EMBODIMENT

Figure 1:
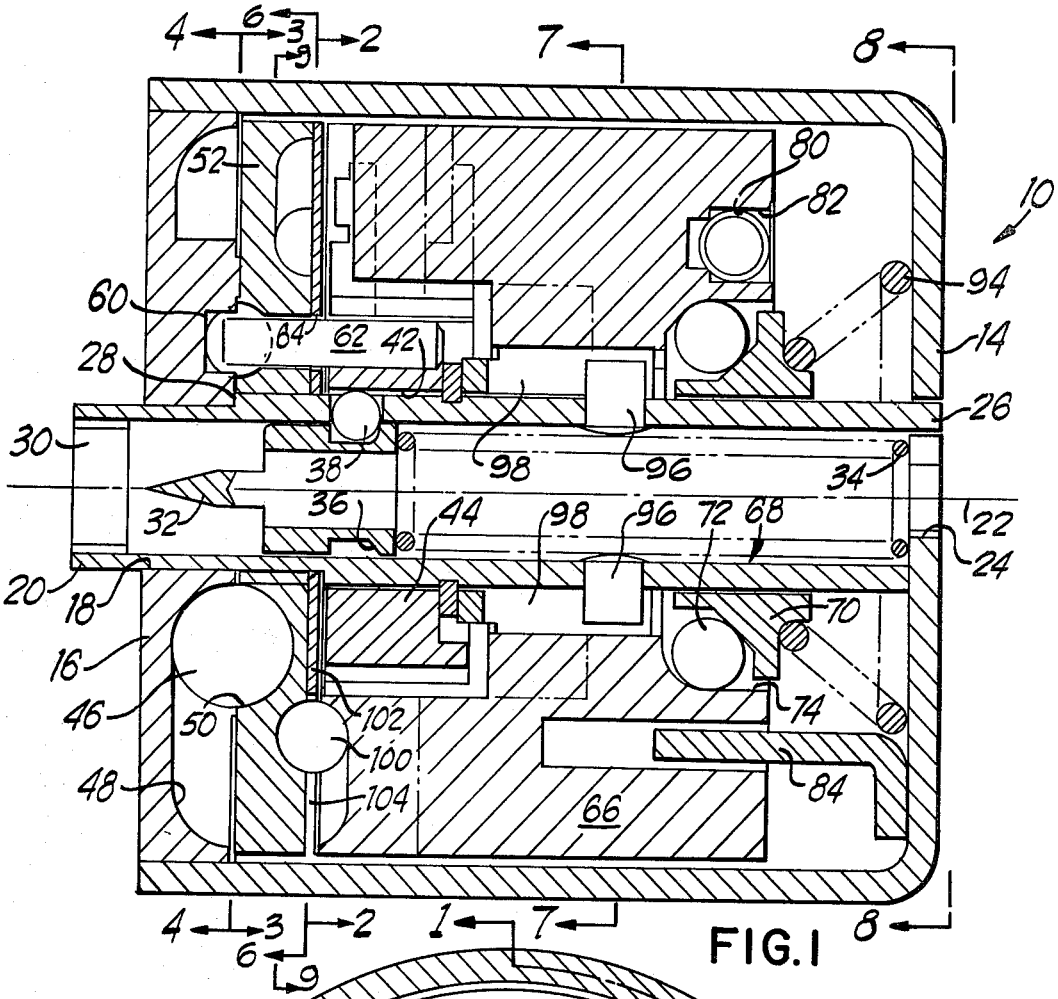
FIG. 1 is a composite axial cross-sectional view of the impact delay fuse of the present invention showing off-set sectional views along the axial length of the device in its "safe" or unfired position. The particular sectional views at the various axial positions corresponding to the location of the transverse cross-sectional views of FIGS. 2, 3, 4, 6 and 7 are taken respectively along line 1—1 of FIG. 2, line 1—1 of FIG. 3, line 1—1 of FIG. 4, line 1—1 of FIG. 6 and line 1—1 of FIG. 7.
Figure 6:
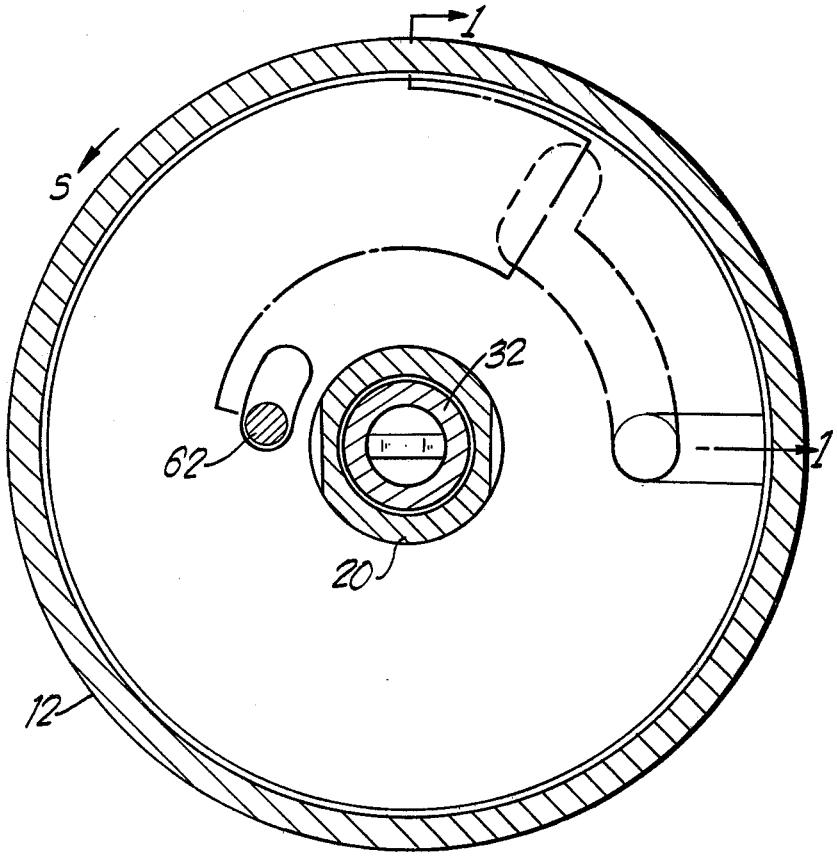
FIG. 6 is a transverse cross-sectional view of the impact delay fuse of the present invention, taken along line 6—6 of FIG. 1 showing the time delay plate positioned between the rotor and the inertia member for preventing relative rotation of the inertia member with respect to the housing until a predetermined period of time after launch of the shell.

Referring now to the figures in which like reference numerals represent like components in the drawings, there is shown in FIG. 1 a composite axial cross-sectional view of the impact delay fuse 10 of the present invention showing the device in its "safe" unfired position. The particular offset sectional views at the various axial positions corresponding to the locations of the transverse cross-sectional view of FIGS. 2, 3, 4, 6 and 7 have been taken, respectively, along line 1—1 of FIG. 2, line 1—1 of FIG. 3, line 1—1 of FIG. 4, line 1—1 of FIG. 6 and line 1—1 of FIG. 7.

The impact delay fuse 10 of the present invention is particularly useful for providing a variable firing delay after target impact of the shell in which the fuse is mounted. The firing delay time, as will be apparent from the description hereinbelow, is based upon a combination of the impact dynamics and the target characteristics, and therefore, provides a significant advantage over prior art fixed time delay fuses which provided a fixed delay period irrespective of impact dynamics and/or target characteristics.

Figure 8:
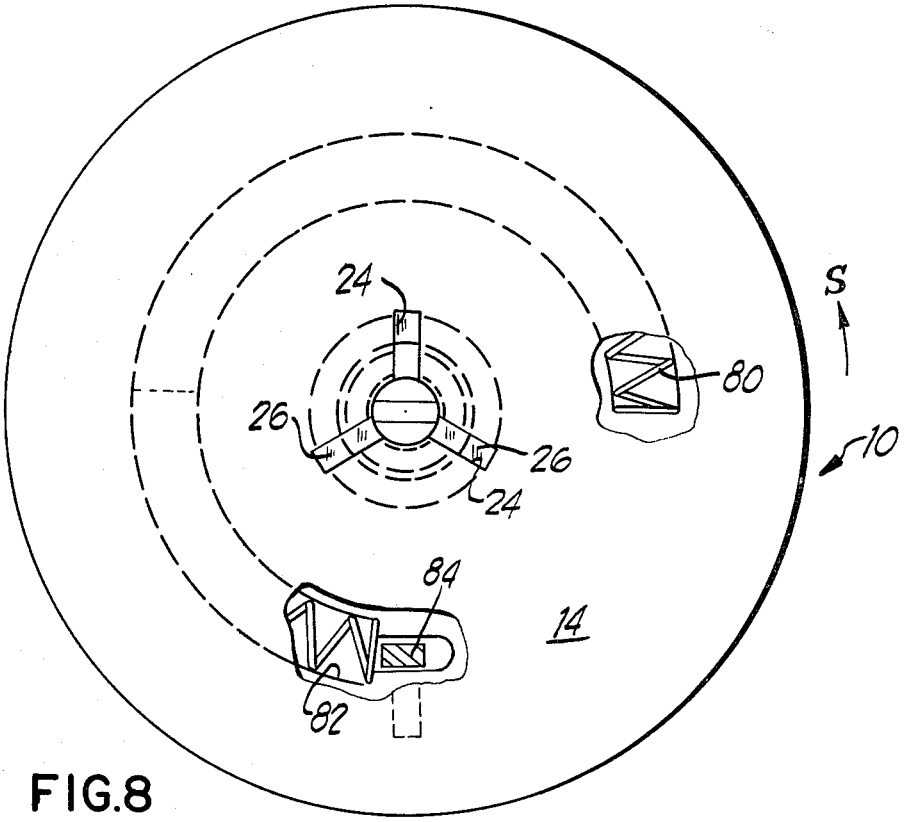
FIG. 8 is a front end view of the impact delay fuse of the present invention, taken along line 8—8 of FIG. 1.

The impact delay fuse 10 of the present invention includes a housing 12 adapted to be mounted on a spin launched projectile or shell (not shown), i.e., a projectile or shell which when launched or fired, such as for example from a cannon, is caused to rapidly spin about the longitudinal axis of the shell or projectile. The housing 12 is generally cylindrical having a partially closed forward end 14 and a rear end closed by a cover 16 having an axial bore 18 therethrough for receiving a firing pin guide sleeve 20. The firing pin guide sleeve 20 extends from the forward end 14 of the housing 12 along the axis 22 of the housing 12 (which is also the shell spin axis) and is held thereinplace between the forward end 14 of the housing 12 and the cover 16. As best seen in FIG. 8, the forward end 14 of the housing 12 includes appropriate openings 24 for receiving axial extensions 26 of the firing pin guide 20 to prevent relative rotation with respect to the housing 12. The rearward end of the firing pin guide 20 includes a lateral projection 28 which is engaged by the cover 16 to maintain the axial position of the firing pin guide 20 within the housing 12. The firing pin guide 20 extends through the axial bore 18 of the cover 16 and, as shown in FIG. 1, is adapted to receive a detonator 30 in the rearward extension of the firing pin guide 20. Of course, it should be understood that the detonator 30 could simply be axially aligned with respect to the firing pin guide 20 instead of being received therein.

Within the interior of the firing pin guide 20, there is provided a firing pin 32 having a pointed front end which is adapted to forcibly strike the detonator 30 to detonate the explosive charge of the shell. There is also provided a firing pin spring 34 which is adapted to be axially compressed to forcibly bias the firing pin 32 into the detonator 30 when the firing pin 32 is released or unlocked.

The firing pin 32 includes an annular groove 36 along the outer surface thereof which is adapted to receive a firing pin lock ball 38 arranged in the appropriate radially extending opening 40 of the firing pin guide 20. The firing pin lock ball 38 is maintained radially inward toward the center of shell spin axis 22 by the inner cylindrical surface 42 of an annular locking sleeve or collar 44 which is coaxially mounted within the housing 12 and with respect to the firing pin guide 20. In this operative locking position, the locking sleeve 44 maintains the firing pin lock ball 38 in engagement with the annular groove 36 on the firing pin 32 to lock the firing pin 32 in a loaded or cocked position. As more fully described hereinbelow, the locking sleeve 44 is movalbe to a release position to permit the firing pin lock ball 38 to move radially outward to release the firing pin 32 to move under the influence of the firing pin spring 34 into the detonator 30.

In order to prevent premature detonation of the shell, there is provided a safe and arming time delay mechanism for preventing detonation of the shell for a predetermined period of time after firing or launching. This is for the purpose of ensuring against the premature detonation of a shell during transportation to the launch sight or during the initial time following launching. In other words, the safe and arming mechanism has been designed to prevent detonation of a shell until the shell has travelled for a predetermined distance or period of time after a launch.

Although a number of different time delay devices may be used in the preferred embodiment, the safe and arming time delay mechanism comprises a spin actuated ball-cam rotor mechanism which is designed to lock the firing pin release mechanism until the centrifugal force induced by the projectile spin upon launch causes the safe and arming mechanism to achieve an "armed" position, at which time the sensing and firing mechanism (to be described hereinbelow) is capable of functioning to release the firing pin 32. Thus, the safe and arming device serves to prevent the sensing and firing mechanism from functioning till the shell has experienced the proper launch environment and has escaped from the balloting, linear accelerations, and/or chugging that may occur while the projectile is still in the gun barrel or shortly after leaving the muzzle of the launching device.

Figure 3:
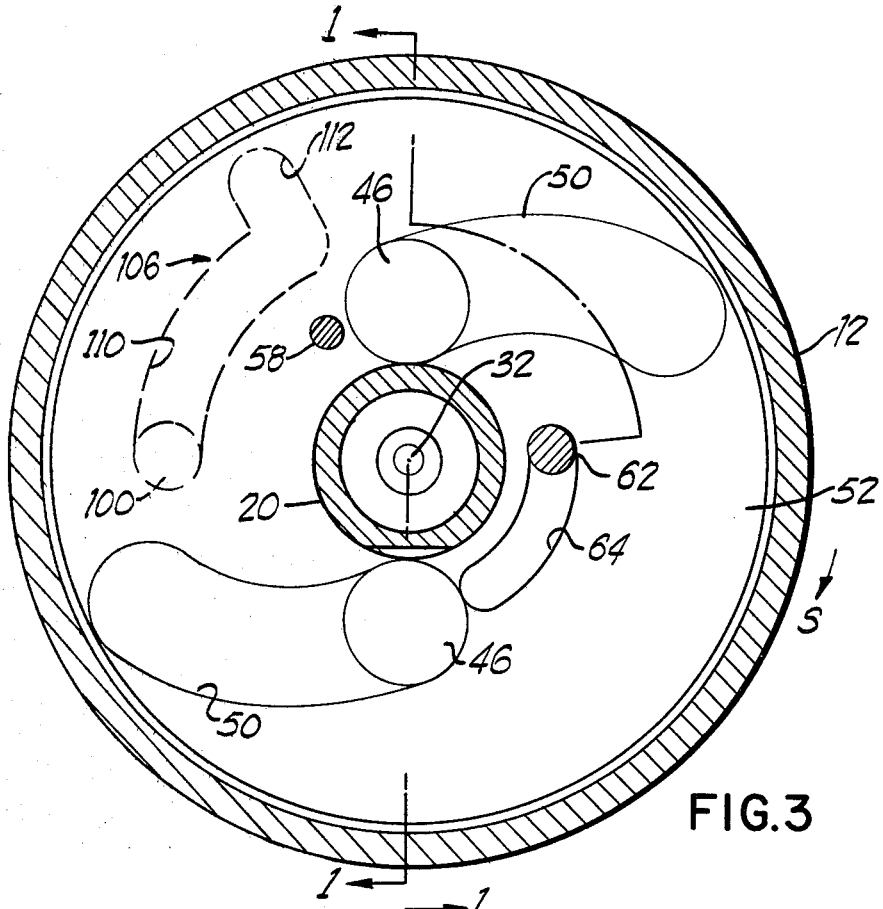
FIG. 3 is a transverse cross-sectional view of the impact delay fuse of the present invention, taken along line 3—3 of FIG. 1 showing the time delay rotor of the present invention.
Figure 4:
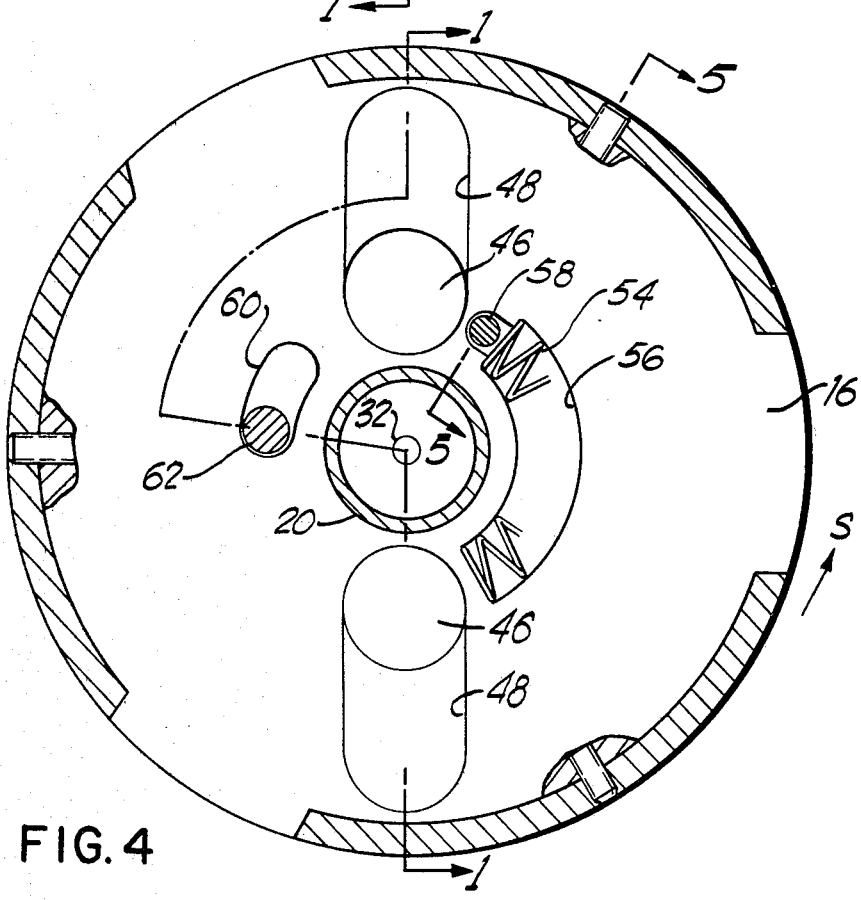
FIG. 4 is a transverse cross-sectional view of the impact delay fuse of the present invention taken along line 4—4 of FIG. 1 showing the interior of the cover of the housing.
Figure 5:
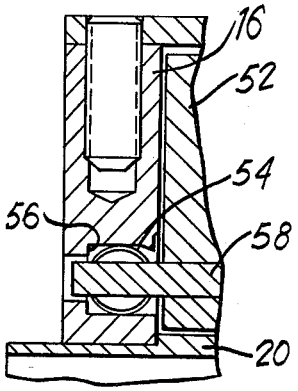
FIG. 5 is a partial axial cross-sectional view taken along line 5—5 of FIG. 4 showing the biasing spring for biasing rotational movement between the rotor and the cover.

The ball-cam rotor mechanism is best seen in FIGS. 1, 3 and 4 and comprises two rotor balls 46 which are disposed in appropriate grooves 48, 50 p rovided in a the axial surfaces of the cover 16 and a rotor 52 which face one another. The two grooves 48 in the cover 16 each extend radially (see FIG. 4) whereas the grooves 50 in the surface of the rotor 52 have an arcuate or spiral contour (see FIG. 3). These grooves 48, 50 face each other and have a depth only slightly larger than the radius of the rotor ball 46 so that the ball motion is constrained by both the cover 16 and the rotor 52. In the "safe" or unfired position, the innermost end of the raidal grooves 48 of the cover 16 are aligned with the radially innermost ends of the spiral grooves 50 of the rotor 52 (see FIGS. 3 and 4). A rotor spring 54 is provided in an arcuate groove 56 of the cover 16 (see FIGS. 4 and 5) so as to bear at one end against a portion of the cover 16 and at the other end against a rotor stop 58 affixed to the rotor 52. The rotor spring 54 serves to bias the rotor 52 to the "safe" position which restricts the rotor balls 46 to their minimum radial position shown in FIGS. 3 and 4.

When the housing 12 is subjected to the high velocity spin environment associated with a shell firing, the two rotor balls 46 experience a significant centrifugal load. The two rotor balls 46 are limited by the grooves 48 of the cover 16 of radial motion, but because of the spiral contour of the rotor grooves 50, the balls 46 can only move radially outward under the influence of the centrifugal force or load as the rotor 52 rotates. Motion of the rotor 52 is produced by the camming action of the rotor balls 46 on the sides of the spiral grooves 50. This camming action in turn places a torque on the rotor 52 which causes it to move to the "armed" position (see FIG. 9). The relatively large mass of the rotor 52 in comparison to the mass of the balls 46 produces the desired delay which is also a function of the spin rate. Until the rotor 52 has moved to the "armed" postion, the sensing and firing function of the device is blocked, as will be more fully described hereinbelow.

The housing cover 16 also includes another arcuate shaped groove 60 which is adapted to receive an axially extending pin 62 which projects axially from the locking sleeve 44. This arcuate shaped groove 60 in the cover 16 serves to permit only clockwise movement about the shell spin axis 22, as viewed in FIG. 4, of the locking sleeve 44 relative to the housing 12 (i.e., as viewed in FIG. 2, only counterclockwise movement of the locking sleeve pin 62 about the spin axis 22 is permitted). The rotor 52 is also provided with an appropriate arc shaped slot 64 through which the locking sleeve pin 62 passes in order to permit relative rotation of the rotor 52 with respect to the locking sleeve pin 62 and with respect to the cover 16 of the housing 12.

The sensing and firing mechanism of the present invention is intended to initiate the fuse explosive train of the shell or projectile after the shell has either passed through the target impact medium, has ricocheted from the target impact surface, has broached from the target impact surface, or has come to rest in the targe impact medium. The mechanism for sensing any of these four conditions is accomplished with use of an inertia weight member 66 which reacts to changes in projectile spin rate and/or projectile velocity rate. This firing initiation is accomplished by releasing the stored energy firing pin 32 when the inertia member 66 has sensed a proper environment.

The inertia weight member 66 is the largest element of the impact delay fuse 10, and is generally annular in shape and is coaxially mounted within the housing 12. Freedom of rotation of the inertia weight 66 is provided by a bearing mechanism 68 comprised of an inner sleeve bearing 70 slidably mounted on the firing pin guide 20 and a plurality of ball bearings 72 disposed between the sleeve bearing and an inner annular surface 74 of the inertia weight 66 to provide a low friction bearing for providing relatively free rotation of the weight 66 relative to the housing 12 in either direction about the shell spin axis 22.

Figure 7:
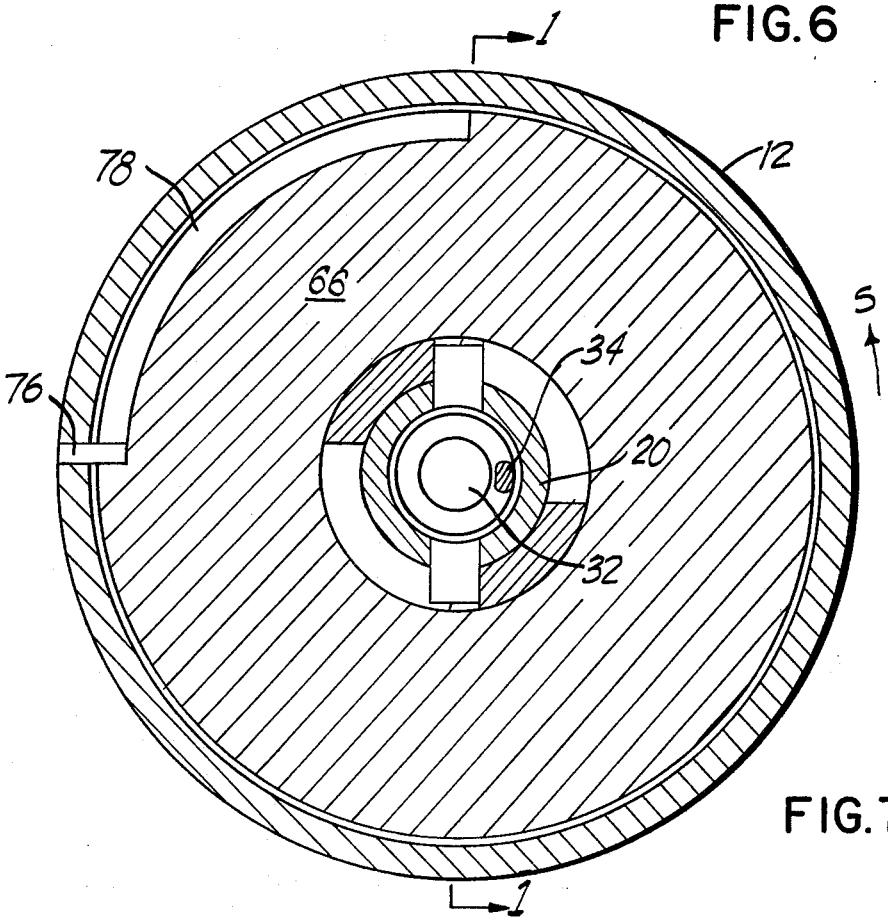
FIG. 7 is a transverse cross-sectional view taken along lien 7—7 of FIG. 1 showing the means for camming pins, the inertia member for rotation relative to the housing in response to the axial movement of the inertia member.

In the preferred embodiment, angular rotation of the inertia weight 66 relative to the housing 12 is limited to 90° by means of a pin 76 which extends from the inner surface of the hollow housing 12 into an arc shaped slot 78 in the outer cylindrical surface of the inertia weight 66, as best seen in FIG. 7. The inertia weight 66 is biased against the stop pin 76 to the counterclockwise extremity of the arc 78 (as viewed in FIG. 8) by a spiral spring 80 disposed in an appropriate arcuate annular groove 82 in the inertia member 66. As seen in FIGS. 1 and 8, the spring 80 bears at one end against the inertia member 66 and at the other end against a spring stop 84 fixably mounted to the housing 12.

Figure 2:
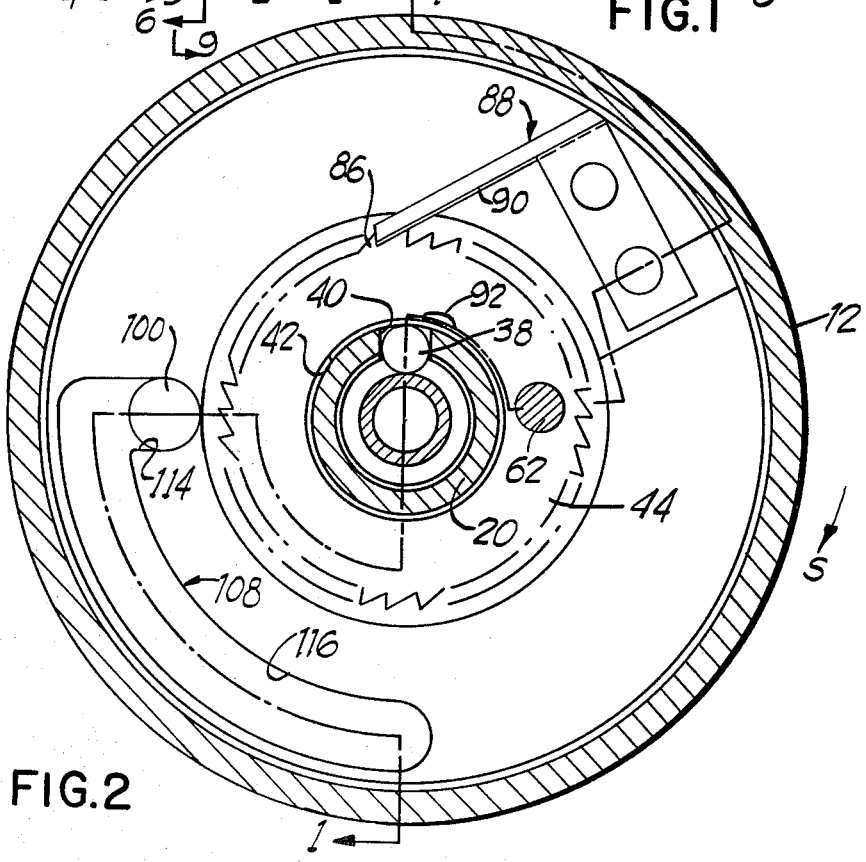
FIG. 2 is a transverse cross-sectional view of the impact delay fuse of the present invention, taken along line 2—2 of FIG. 1 showing how the interia member and the locking member are coupled together.

As best seen in FIG. 2, the outer cylindrical surface of the locking sleeve or collar 44 is provided with a plurality of inclined ratchet teeth 86, inclined in a generally clockwise direction as viewed in FIG. 2. These teeth 86 are adapted to be engaged by a ratchet spring mechanism 88 fixably mounted to the inertia weight member 66 and having a ratchet arm 90 extending toward the inclined teeth 86 at an angle. This arrangement permits the inertia weight member 66 to which the ratchet spring 88 is mounted, to rotate relative to the locking sleeve 44 in a clockwise direction (as viewed in FIG. 2) without causing corresponding movement of the locking sleeve 44. In this regard, it is to be noted that such clockwise movement as viewed in FIG. 2 of the locking sleeve 44 is prevented by the locking sleeve pin 62 which extends into and engages the arcuate groove 60 in the cover 16. On the other hand, counterclockwise rotation of the inertia member 66 about the shell spin axis 22 (as viewed in FIG. 2) causes the ratchet arm 90 to engage a ratchet tooth 86 to rotate the locking sleeve 44 with the inertia weight 66 in a counterclockwise direction (as viewed in FIG. 2). In other words, with the particular arrangement of the ratchet spring 88 and the locking sleeve 44 having ratchet teeth 86 on the outer surface thereof, relative rotation in a clockwise direction (as viewed in FIG. 2) is permitted between the inertia weight 66 and the locking sleeve 44 whereas rotation in the opposite direction causes the two components 44, 66 to be rotated together. In this regard, it is to be noted that counterclockwise motion of the locking sleeve 44 (as viewed in FIG. 2) is permitted as a result of the arcuate groove 60 in the cover 16.

Further, it is to be noted that the locking sleeve 44 is provided with a radially extending recessed opening 92 in the inner cylindrical surface 42 thereof which, when rotated into position to be in alignment with the radial opening 40 in the firing pin guide 20, is adapted to receive the firing pin lock ball 38 to release the firing pin 32. As seen in FIG. 2, in the initial position, this recessed opening 92 in the locking sleeve 44 is angularly displaced approximately 15° in a clockwise direction so that counterclockwise movement through an angle of 15° will cause the recessed opening 92 to be aligned with the firing pin lock ball 38. It is to be noted that the counterclockwise motion of the locking sleeve 44 about the pin axis 22 (as viewed in FIG. 2) is limited to the position in which the recessed opening 92 is aligned with the lock ball 38 by means of the arcuate groove 60 in the cover 16 being engaged at the opposite end by the pin 62 of the locking sleeve 44 (see FIG. 4).

As will be recalled, the sensing and firing mechanism is locked into its initial position by a safe and arming mechanism until the projectile has reached stabilized flight and the rotor 52 has rotated to its "armed" position. Further, it will be noted that upon launch, the shell and thus the housing 12 are adapted to spin in a counterclockwise direction as shown in FIG. 8. The direction of spin of the housing 12 as shown in each of the transverse cross-sectional FIGS. 2, 3, 4, 6, 7 and 8 is designated by the arrow "S" in each of the figures. Therefore, it is seen that this rapid spinning action of the housing 12 causes the inertia weight member 66 to also spin with the housing 12 in a counterclockwise direction by virtue of the fact that the inertia weight 66 is engaged by the stop member 76 on the housing 12 (see FIG. 7). Therefore, the initial configuration of the inertia weight 66, the firing pin 32 and the locking sleeve 44 are maintained from the time the mechanism is assembled until it impacts a target.

When the shell strikes a target, the shell and thus the housing 12 experience an angular deceleration in response to the impact, whether the impact is grazing or penetrating. Thus, in view of the free rotational support of the inertia weight 66 upon impact and the experiencing of the annular deceleration, the inertia weight 66 is displaced in a clockwise direction, as viewed in FIG. 2 (or counterclockwise as viewed in FIG. 7) relative to the housing 12. The amount of rotation depends on the magnitude and duration of the deceleration, but is limited up to a limit of 90° of rotation by the extent of the arcuate slot 78 in the inertia weight 66. It will be recalled that this rotational movement of the inertia weight 66 in a clockwise direction (as viewed in FIG. 2) relative to the housing 12 causes the inertia member 66 to also rotate clockwise relative to the locking sleeve 44. After the projectile has emerged from the target medium, has come to rest in it, or has ricocheted from it so that the projectile experiences only minimum or no angular deceleration, the inertia bias spring 80 drives the inertia weight 66 counterclockwise (as viewed in FIG. 2; clockwise as viewed in FIG. 7) toward the initial position. Since the ratchet spring 88 locks the inertia weight 66 to the locking sleeve 44 during this counterclockwise movement the locking sleeve 44 also rotates about the spin axis 22 in a counterclockwise direction (as viewed in FIG. 2). After approximately 15° of angular rotation in this direction, the recessed opening 92 in the locking sleeve 44 is aligned with the lock ball 38. The lock ball 38 is then free to move radially outward under the combined loads of the firing pin 32, the projectile spin or tumbling. This releases the constraint on the firing pin 32 which is then driven by the firing pin spring 34 into the detonator 30.

In the preferred embodiment, the clockwise rotation of the inertia weight 66 (as viewed in FIG. 2) relative to the housing 12 caused upon impact can also be accomplished as a result of linear deceleration of the housing 12. This rotational movement of the inertia member 66 as a result of linear deceleration may be used in place of the angular deceleration effect or in addition thereto. The use of a linear deceleration mode for cocking of the inertia weight 66 relative to the housing 12 is particularly useful in the situations where the angular deceleration may not be significant enough to overcome the bias force of the spiral inertia spring 80.

In the preferred embodiment, both angular and linear deceleration are used for the cocking function of moving the inertia member 66 relative to the housing 12. In this way, improved reliability can be obtained where there are low angular deceleration environments and/or greater translational deceleration environments. However, it is to be noted that whether the angular and/or linear deceleration functions are used for rotating the inertia member 66 relative to the housing 12, firing or release of the firing pin 32 occurs upon the termination of angular deceleration. This is advantageous since angular deceleration provides a unique indication that the projectile has emerged from the target medium or has come to rest.

In using linear deceleration for the cocking function, the inertia member 66 is mounted within the housing 12 so as to be capable of linear or axial movement relative to the housing 12. In the preferred embodiment, this is accomplished by supporting the inertia member 66 in spaced relationship from the forward end 14 of the housing 12 and providing an axial bias spring 94 for biasing the inertia member 66 toward the rearward end of the housing 12. Camming pins 96 are provided which extend laterally outward from the firing pin guide 20 to engage cammed surfaces 98 on the inner cylindrical surfaces of the inertia weight 66 so that linear movement of the inertia member 66 toward the forward end 14 of the housing 12 will cause the inertia member 16 to rotate clockwise (as viewed in FIG. 2; counterclockwise as viewed in FIG. 7). Therefore, when the projectile impacts on a target, translational energy stored within the inertia member 66 will serve to cause the inertia member 66 to move forward relative to the housing 12 against the spring bias force of spring 94 to thereby cam or rotate the inertia member 66 relative to the housing 12. When angular deceleration terminates or becomes less than the biasing force of the spiral spring 80, the inertia member 66 will be rotated in the opposite direction relative to the housing 12 to thereby rotate the locking sleeve 44 in a counterclockwise direction (as viewed in FIG. 2) to release the firing pin 32.

Figure 9:
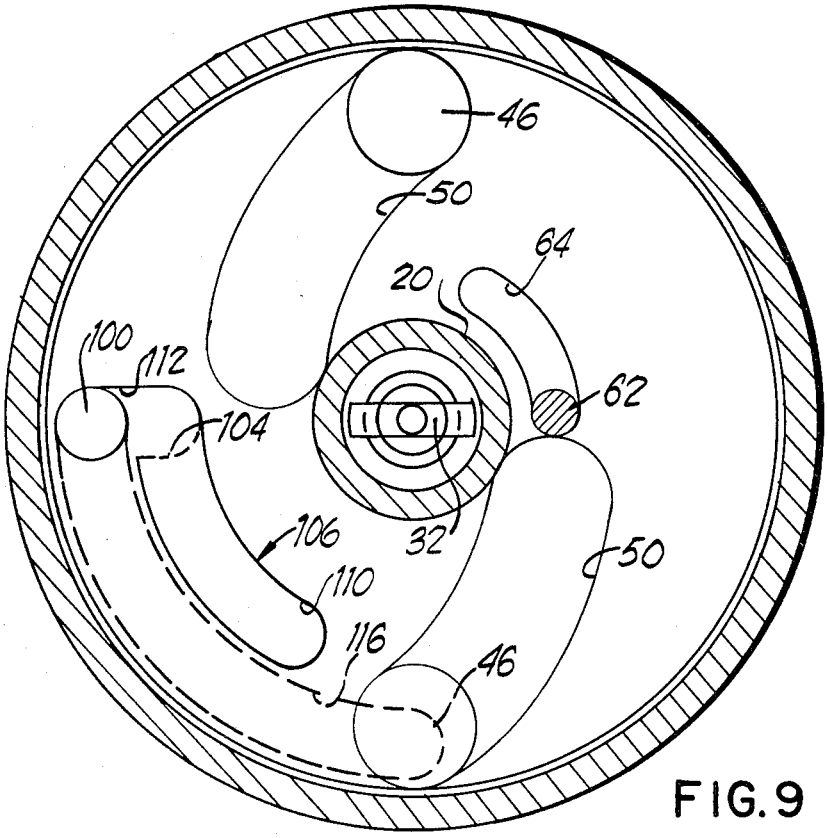
FIG. 9 is a transverse cross-sectional view taken along line 9—9 of FIG. 1, with portions removed therefrom for clarity, showing the relative alignment of the rotor, the time delay plate and the inertia member in the "armed" position after the rotor has been rotated into position to release the inertia member for relative rotation with respect to the housing.

The interface between the safe and arming mechanism and the sensing and firing mechanism for locking of the rotational position of the inertia member 66 until the projectile or shell has reached stabilized flight comprises an inertia rotor ball 100 and a thin plate 102 disposed between the rotor 52 and the inertia member 66 within the housing 12. These two components 100, 102 take the input from the safe and arming mechanism to control the activation of the sensing and firing mechanism. The thin plate 102 is provided with a radially extending slot 104 which extends partially from the outer circumference thereof toward the center of the plate 102 (see FIG. 9). The inertia rotor ball 100 is disposed in this slot 104 and is adapted to move in appropriate grooves 106, 108 provided in the opposed surfaces of the rotor 52 and the inertia member 66. The groove 106 in the rotor 52 includes an inner arcuate portion 110 and a radially extending portion 112 joined thereto. In the initial position, the inner arcuate portion 110 is aligned with the innermost radial end of the slot 104 in the plate 102 so that rotational movement of the rotor 52 maintains the ball 100 in its radial inner position in the slot 104 until the rotor 52 has rotated to the "armed" position at which time the ball 100 is free to move radially outward under centrifugal load. This position is shown in FIG. 9. The groove 108 in the inertia member 66 includes a radially extending portion 114 and an outer arcuate portion 116. In the initial position, the radial portion 114 of the inertia member groove 66 is aligned with the radially extending slot 104 in the plate 102 so that the inertia rotor ball 100 locks any movement of the inertia member 66 until the ball 100 is moved to the extreme radial position where it is aligned with the outer arcuate portion 116 of the inertia member 66 to permit free rotational movement of the inertia member 66 relative to the housing 12. Thus, the inner arcuate portion 110 of the rotor groove 106 is initially aligned to maintain the ball 100 in the innermost radial position of the slot 104 of the plate 102 to thereby prevent rotation of the inertia member 66 relative to the housing 12 until such time as the rotor 52 has rotated to the "armed" position at which time the radially extending portion 112 of the rotor groove 106 is aligned to permit radially outward movement of the rotor ball 106 in the slot 104 and in the groove 108 of the inertia member 66 (see FIG. 9).

Thus, it is seen that the present invention provides an improved impact delay fuse 10 for providing a firing delay after impact of a spin launched projectile or shell with a target. The impact delay fuse 10 comprises a housing 12, a detonator device 32 for detonating the explosive charge of the shell and locking member 44 for maintaining the detonator device 32 in a loaded or cocked position prior to launching of the shell. The housing 12 is adapted to be mounted on the spin launched shell for rotation therewith in a first direction about the shell spin axis 22. The locking member 44 is adapted to be rotated about the shell spin axis 22 in a second direction (opposite to the first direction) relative to the housing 12 to a release position to release the detonator device 32 to initiate the explosive charge of the shell. A sensing and firing mechanism is provided for controlling rotation of the locking member 44 in the second direction relative to the housing 12. The sensing and firing mechanism comprises an inertia member 66 coaxially arranged within the housing 12, an inertia mounting means for mounting the inertia member 66 to rotate with the housing in the first direction when the shell is launched and for rotating in the first direction relative to the housing 12 when the shell impacts with the target. Inertia biasing means 80 are provided for biasing the inertia member 66 for rotation in the second direction relative to the housing 12 and coupling means 86, 88 are provided for coupling the inertia member 66 with the locking member to rotate the locking member 44 in the second direction when the inertia member 66 is rotated in the second direction and to move relative to the locking member 44 when the inertia member 66 is rotated in the first direction relative to the housing 12. The impact delay fuse 10 of the present invention also includes a time delay device for preventing movement of the inertia member 66 relative to the housing 12 for a predetermined period of time after launch of a shell to prevent premature detonation of the shell.

While the preferred embodiment of the present invention has been shown and described, it will be understood that such is merely illustrative and that changes may be made without departing from the scope of the invention as claimed.

What is claimed is:

1. An impact delay fuse for use in a spin launched explosive shell to delay detonation of the explosive charge of the shell until after impact of the shell with a target, said delay fuse comprising:

a hollow housing adpated to be positioned in said shell for rotation therewith in a first direction about a shell spin axis when the shell is launched and begins to spin;

detonation means for detonating the explosive charge of said shell, said detonation means being movable between a loaded position and a detonating position, and being biased toward said detonating position;

a locking member coaxially mounted within said housing for rotation between a first position and a second position disengaged from said detonator means so that said locking member when in said first position being in engagement with said detonation means so as to maintain said detonator means in said loaded position and said locking member when in said second position being disengaged from said detonation means so that said detonation means is free to be moved to said detonating position; and a sensing and firing mechanism for controlling rotation of said locking member between said first and second positions, said sensing and firing mechanism comprising:

an inertia member within said housing;

inertia mounting means for mounting said inertia member coaxially within said housing to rotate said inertia member with said housing in said first direction when said shell is launched and to rotate said inertia member in said first direction for a predetermined distance relative to said housing when said shell impacts the target;

inertia bias means for biasing said inertia member for rotation in a second direction relative to said housing, said second direction of rotation being opposite from said first direction of rotation; and coupling means for engaging said locking member with said inertia member for rotation therewith only when said inertia member is rotated in said second direction relative to said housing.

2. The impact delay fuse of claim 1 wherein said inertia mounting means comprises:

bearing means for supporting said inertia member for rotation in said first and second directions relative to said housing, and a stop member on the interior of said housing engagable with a portion of said inertia member to cause rotation of said inertia member with said housing in said first direction when said shell is launched;

wherein said inertia bias means normally biases said portion of said inertia member against said stop member; and wherein said inertia member is movable in said first direction relative to said stop member against said inertia bias means whereby when said housing is subjected to spin deceleration upon impact with the target said inertia member will rotate in said first direction against said inertia bias means for said predetermined distance relative to said housing.

3. The impact delay fuse of claim 2 wherein said inertia mounting means further comprises:

means for supporting said inertia member for axial movement of said inertia member relative to said housing upon impact of said shell with said target, a camming member on one of said housing and said inertia member, and a corresponding camming surface on the other of said housing and inertia member for camming said inertia member to rotate in said first direction relative to said housing in response to axial movement of said inertia member relative to said housing.

4. The impact delay fuse of claim 2 or 3 wherein said inertia biasing means comprises a spiral spring engagable with said inertia member and with said housing.

5. The impact delay fuse of claim 1 wherein said inertia mounting means comprises:

means for supporting said inertia member for axial movement of said inertia member relative to said housing upon impact of said shell with said target, a camming member on one of said housing and said inertia member, and a corresponding camming surface on the other of said housing and said inertia member for camming said inertia member to rotate in said first direction relative to said housing in response to axial movement of said inertia member relative to said housing.

6. The impact delay fuse of claim 3 or 5 wherein said means for supporting said inertia member for axial movement comprises a spring member disposed axially between said inertia member and an axial fce of said housing for biasing said inertia member in an axial direction away from the axial component of movement of said shell upon launching of said shell so that said inertia member is axially movable in the direction of axial movement of said shell against the bias force of said spring member when said shell impacts with the target.

7. The impact delay fuse of claim 3 in which said cam surface is disposed on said inertia member and in which said cam member is fixably mounted with respect to said housing.

8. The impact delay fuse of claim 5 in which said cam surface is disposed on said inertia member and in which said cam member is fixably mounted with respect to said housing.

9. The impact delay fuse of claims 7 or 8 in which said housing includes an axially extending guide sleeve coaxially mounted with respect to said spin axis of said housing, said cam member being disposed radially outward from said guide sleeve, and wherein said inertia member is annular and coaxially mounted with respect to said guide sleeve with said camming surface located on the inner annular surface of said inertia member.

10. The impact delay fuse of claim 1 wherein said coupling means comprises a ratchet wheel having inclined teeth and a ratchet pawl, said ratchet wheel being fixably mounted on one of said inertia member and said lock member, and said ratchet pawl being mounted on the other of said inertia member and said lock member so that said ratchet wheel and said ratchet pawl move relative to one another when said inertia member is rotated in said first direction with respect to said housing and so that said ratchet pawl and ratchet wheel are engaged to rotate together when said inertia member is rotated in said second direction relative to said housing.

11. The impact delay fuse of claim 10 in which said ratchet wheel is disposed on said locking member and wherein said ratchet pawl is disposed on said inertia member.

12. The impact delay fuse of claim 1 wherein said detonation means comprises a detonator fixably supported relative to said housing, a firing pin axially movable relative to said housing, and a firing pin spring for biasing said firing pin towards said detonator, said locking member when in said first position locking said firing pin in an axial position spaced from said detonator.

13. The impact delay fuse of claim 12 wherein said detonation means further includes an annular guide sleeve coaxially mounted in said housing and surrounding said movable firing pin, a radial opening in the side wall of said guide sleeve, and a locking ball in said opening; wherein said firing pin includes an annular groove engagable by said locking ball; and wherein said locking member comprises an annular locking sleeve coaxially supported relative to said firing pin and said guide sleeve, said locking sleeve having a cylindrical inner side wall and a recessed opening in a portion of said cylindrical inner side wall, said cylindrical inner side wall of said locking sleeve when said locking sleeve is in said first position holding said locking ball in engagement in said annular groove of said firing pin to prevent axial movement of said firing pin, and said locking sleeve when in said second position having said recessed opening aligned with said opening in said guide sleeve so that said locking ball is free to move radially outward into said recessed opening to release said firing pin.

14. The impact delay fuse of claim 1 further including a time delay device for preventing movement of said inertia member relative to said housing for a predetermined period after launch of said shell to prevent premature detonation of said shell.

15. the time delay device of claim 14 wherein said time delay device comprises:

a rotatable rotor coaxially mounted within said housing and adapted to rotate relative to said housing between a start position and an armed position;

means responsive to the rotation of said housing for rotating said rotor from said start position to said armed position; and rotation prevention means on said rotor for preventing rotation of said inertia member relative to said housing until said rotor is in said armed position.

16. The impact delay fuse of claim 15 wherein said housing includes a cover adjacent to said rotor, said cover including at least one radially extending groove therein; wherein said rotor includes at least one arcuate groove in the surface thereof facing said cover; and wherein said means for rotating said rotor comprises a rotatable ball disposed between said radially extending groove of said cover and said arcuate groove of said rotor, one end of said arcuate groove of said rotor being aligned with the innermost end of said radially extending groove of said cover when said rotor is in said start position and the other end of said arcuate groove being aligned with the outermost end of said radial groove when said rotor is in said armed position so that rotation of said housing causes said ball to move radially outward in said grooves to thereby rotate said rotor from said start position to said armed position.

17. The impact delay fuse of claim 16 wherein said rotation prevention means comprises:

an inertia rotor ball;

an inertia member groove in the axial surface of said inertia member facing said rotor, said inertia member groove having an outer arcuate portion and a radially extending portion, the radially outermost end of said radially extending portion of said inertia member groove communicating with one end of said outer arcuate portion; and a rotor groove in the axial surface of said rotor facing said inertia member, said rotor groove having an inner arcuate portion and a radially extending portion, said radially extending portion of said rotor groove extending radially outward from one end of said inner arcuate portion, said radially extending portion of said rotor groove being coextensive with said radially extending portion of said inertia member groove when said rotor is in said armed position, and said inner arcuate portion of said rotor groove being aligned with the radially innermost end of said radially extending portion of said inertia member groove when said rotor is in a position other than said armed position so that said inertia rotor ball is disposed in the radially innermost end of said radially extending portion of said inertia member groove to prevent rotation of said inertia member relative to said housing until said rotor is in said armed position.

18. The impact delay fuse of claim 17 further including a plate fixably mounted between said rotor and said inertia member, said plate having a radially extending slot in which said inertia rotor ball is disposed, said radially extending slot being coextensive with said radially extending portion of said inertia member groove when said rotor is in a position other than said armed position and being coextensive with said radially extending portion of said rotor groove when said rotor is in said armed position.

19. The impact delay fuse of claim 1 further including means for preventing rotation of said locking member in said first direction relative to said housing and for permitting a predetermined amount of rotation of said locking member in said second direction relative to said housing.

20. The impact delay fuse of claim 19 in which said means for preventing rotation of said locking member in said first direction comprises a slot in a portion of said housing, and a pin on said locking member extending axially into said slot, said slot in said housing being arcuate so that said pin is movable in said slot to provide said predetermined amount of rotation of said locking member in said second direction relative to said housing but to prevent movement of said pin in said first direction relative to said housing.

* * * * *